US006029478A

United States Patent [19]

Panuccio

[11] Patent Number: 6,029,478

[45] Date of Patent: Feb. 29, 2000

[54] KNITTING MACHINE WITH PLURAL KNITTED FABRIC TENSIONING ROLLERS

[75] Inventor: Vincenzo Panuccio, Castronno, Italy

[73] Assignee: MEC-MOR S.r.l., Induno Olona, Italy

[21] Appl. No.: 09/113,377

[22] Filed: Jul. 10, 1998

[30] Foreign Application Priority Data

Jul. 18, 1997 [IT] Italy ..... MI97A1717

[51] Int. Cl.[7] ..... D04B 15/88

[52] U.S. Cl. ..... 66/153; 66/149 R

[58] Field of Search ..... 66/153, 149 R, 66/151, 150, 152, 149 S; 139/304, 305, 309, 457, 11; 242/530.1, 530.3

[56] References Cited

U.S. PATENT DOCUMENTS

| | | | |
|---|---|---|---|
| 2,362,485 | 11/1944 | Hofmann et al. | 66/149 R |
| 3,547,332 | 12/1970 | Gaudin | 242/530.1 |
| 3,566,622 | 3/1971 | Iannucci | 66/151 |
| 3,878,999 | 4/1975 | Daves | 242/530.1 |
| 4,777,808 | 10/1988 | Kuhnert | 66/149 R |

*Primary Examiner*—Andy Falik

*Attorney, Agent, or Firm*—Guido Modiano; Albert Josif; Daniel J. O'Byrne

[57] ABSTRACT

A device for tensioning knitted fabrics in knitting machines, particularly in large-diameter circular machines device comprises a plurality of tensioning rollers which are arranged side by side so as to contact substantially all the transverse extension of the fabric, said rollers being arranged below the needle work area of the machine. Each tensioning roller cooperates with a contrast roller which acts on the face of the fabric that is opposite to the face that makes contact with the tensioning rollers and is orientated so that its axis is parallel to the axis of the corresponding tensioning roller. There are actuators for actuating the tensioning rollers so that they rotate about their respective axes in order to apply traction to the fabric being formed. The actuators comprise, for each tensioning roller, a motor which can be actuated independently or in correlation with the actuation of the motors that actuate the other tensioning rollers.

10 Claims, 3 Drawing Sheets

KNITTING MACHINE WITH PLURAL KNITTED FABRIC TENSIONING ROLLERS

BACKGROUND OF THE INVENTION

The present invention relates to a device for tensioning knitted fabrics in knitting machines, particularly in large-diameter circular machines.

It is known that machines for producing knitted fabrics can be classified in three broad categories: straight-bar machines, circular machines for producing a closed tubular fabric, and circular machines for producing an open tubular fabric.

Straight-bar machines use devices for tensioning the fabric being formed which are generally constituted by two or three rollers or by pairs of mutually facing narrow belts which are arranged below the needle work area. The fabric formed by the needles passes between the rollers or narrow belts, which can be actuated so as to apply to the fabric being formed the chosen degree of tensioning, which is necessary to facilitate the needle in holding the stitch.

Circular machines for manufacturing a closed tubular fabric usually have tensioning devices which are accommodated inside the needle cylinder of the machine and have adapted elements which grip the fabric that descends inside the needle cylinder and is gradually wound onto a specifically provided roll located in the footing of the machine. The fabric gripping elements vary as a function of the type of machine but usually apply grip to the entire fabric.

In circular machines for producing an open tubular fabric, generally large-diameter circular machines, there is a plurality of tensioning rollers which are arranged so that their axes lie along a polygonal line inside the needle cylinder and below the needle work area. The tensioning rollers face respective contrast rollers which are usually supported so as to freely rotate about their axes and are parallel to the axis of the correspond tensioning roller. The tensioning rollers are actuated so as to rotate about their respective axes in order to tension the fabric that passes between the tensioning rollers and the contrast rollers. The tensioning rollers are actuated by means of a single motor, with an interposed single reduction unit for all of the rollers, which is torque-controlled and can remain tensioned even when no fabric is being formed.

In any case, when knitting machines start to produce fabric, they do so by gradually knitting a plurality of stitch sets along the transverse extension of the fabric. When this occurs, the sets that produce knitting loosen the tension at the needles that are already knitting, while the situation remains unchanged on the remaining part of the needles. The force applied to the fabric by conventional tensioning devices is thus discharged onto a number of needles which gradually decreases; accordingly, the specific tension on said number of needles is increased. Because of this fact, tension is unequal in the various regions of the fabric, and this is a problem since it can cause knitting defects which are all the more evident as the difference between the length of the fabric formed by a given group of needles and the length of the fabric formed by other needle groups increases.

This problem is even greater in case of particular knitting styles, such as for example braiding, which are particularly appreciated from an aesthetic point of view and are characterized by extreme differences in style among the regions of the same fabric sheet. The different degree of tension of the fabric in the various regions in fact leads to different stitch-holding conditions of the various needles, with the possibility of knitting defects if this difference is particularly high, or in any case to uneven stitch-holding conditions which negatively affect the quality of the fabric.

SUMMARY OF THE INVENTION

The aim of the present invention is to solve the above problems, providing a device for tensioning knitted fabrics in knitting machines, particularly in large-diameter circular machines, which allows to provide uniform tensioning, regardless of the type of knitting being produced, in the various regions of the fabric possibly subjected to mutually different knitting types.

Within the scope of this aim, an object of the invention is to provide a device for tensioning knitted fabrics which can be actuated in each case so as to simultaneously ensure the maximum degree of productivity obtainable with the machine on which it is installed and a high quality of the produced fabric.

Another object of the invention is to provide a device for tensioning knitted fabrics which is simple to manage as regards its actuation in relation to the various kinds of knitting that can be performed on the machine in which it is installed.

This aim, these objects and others which will become apparent hereinafter are achieved by a device for tensioning knitted fabrics in knitting machines, particularly in large-diameter circular machines, which comprises a plurality of tensioning rollers which are arranged side by side so as to affect substantially all of the transverse extension of the fabric and are arranged below the needle work area of the machine, each one of said tensioning rollers cooperating with a contrast roller which acts on the face of the fabric that is opposite to the face that makes contact with said tensioning rollers and is orientated so that its axis is parallel to the axis of the corresponding tensioning roller, means being provided for actuating said tensioning rollers so that they rotate about their respective axes in order to apply traction to the fabric being formed, characterized in that said actuation means comprise, for each one of said tensioning rollers, a motor which can be actuated independently or in correlation with the actuation of the motors that actuate the other tensioning rollers.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
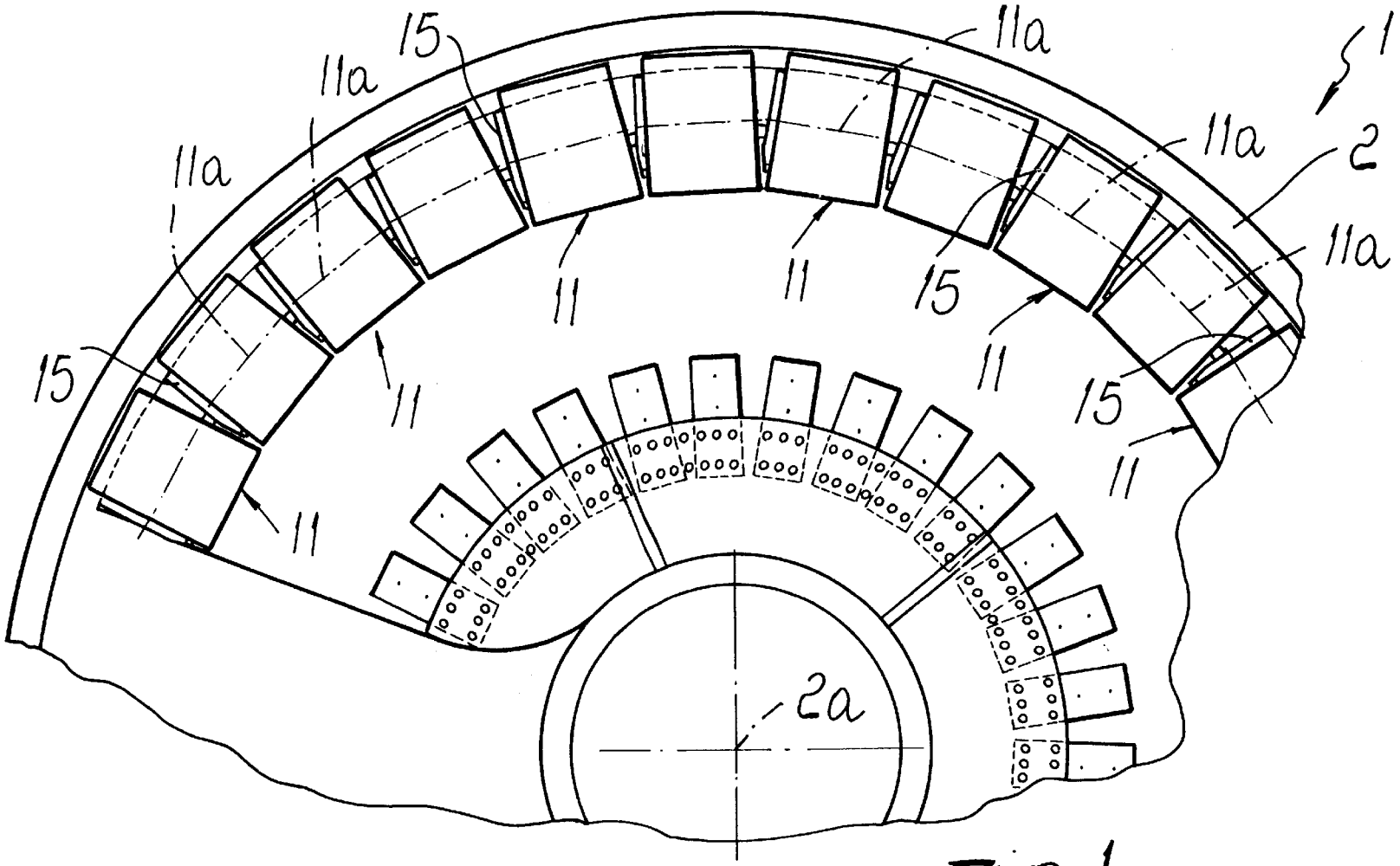
FIG. 1 is a schematic view of the device according to the invention, with the contrast rollers omitted for the sake of clarity, installed in a large-diameter circular knitting machine, which is shown in a sectional view taken along a horizontal plane, i.e., at right angles to the needle cylinder axis.
Figure 2:
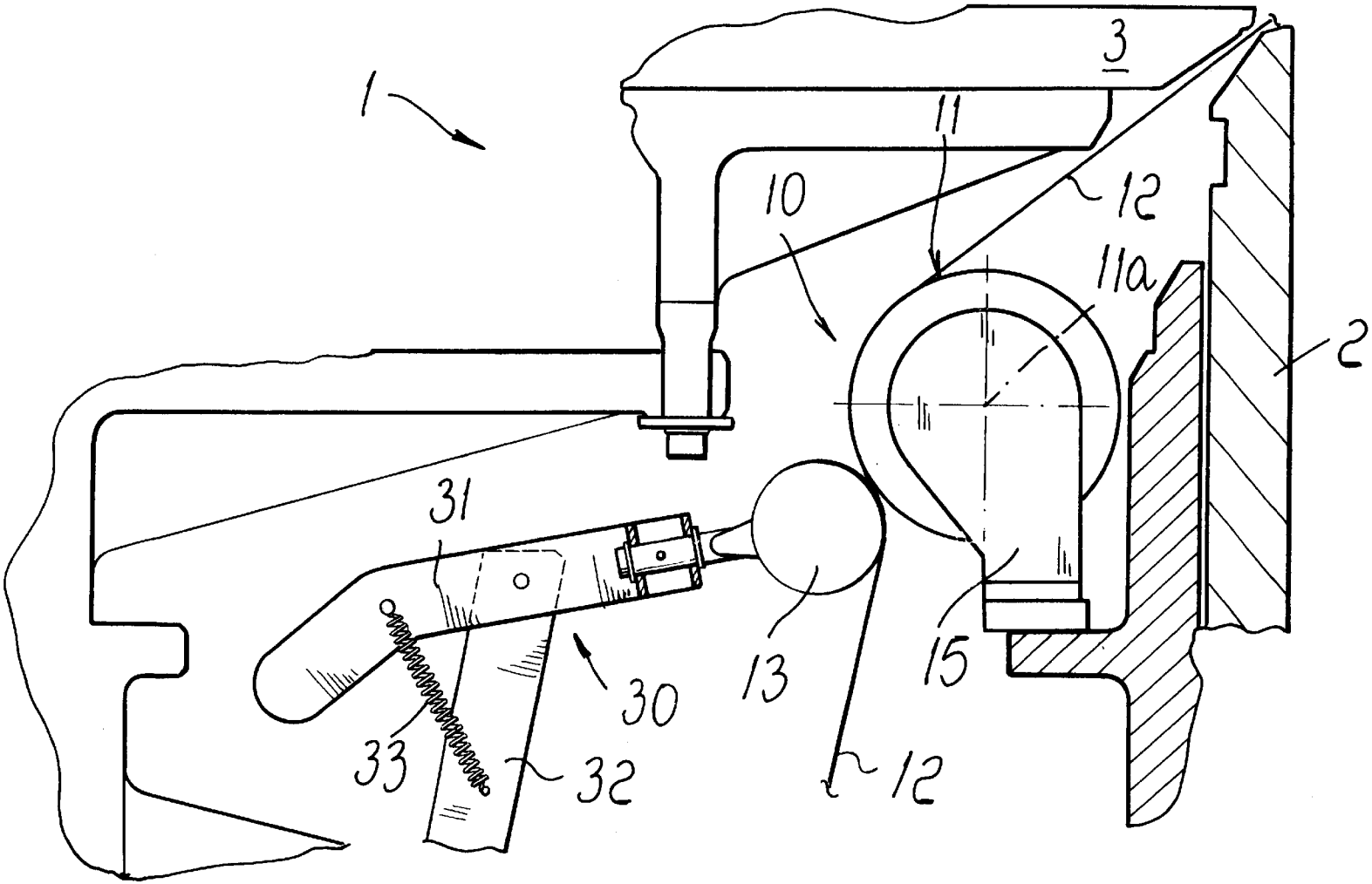
FIG. 2 is a schematic view of the device according to the invention, installed in a large-diameter circular machine, which is shown in a sectional view taken along a radial plane, i.e., on a plane which passes through the axis of the needle cylinder.

The device according to the invention is shown applied to a large-diameter circular machine, generally designated by the reference numeral 1, which comprises a needle cylinder 2 which is arranged so that its axis 2*a* is vertical and is faced, in an upward region, by a dial 3 arranged coaxially to the needle cylinder 2.

Both the needle cylinder 2 and the dial 3 have needles which face the edge of the dial 3 that faces the upper end of the needle cylinder 2 and forms the needle work area.

The device according to the invention is accommodated in the needle cylinder 2, below the needle work area, and is generally designated by the reference numeral 10.

The device according to the invention comprises a plurality of tensioning rollers 11 which are arranged side by side or coaxially, so as to substantially affect all of the transverse extension of the fabric 12, and are arranged below the needle work area of the machine.

The tensioning rollers 11 cooperate with contact rollers 13, (not shown in FIG. 1 for the sake of simplicity) which are also arranged within the needle cylinder 2 of the machine and are supported, preferably so as to rotate freely, about their respective axes, which are parallel to the axes 11*a* of the tensioning rollers 11, so as to make contact with the face of the fabric 12 that is opposite with respect to the face with which the tensioning rollers 11 make contact.

The device comprises means for actuating the tensioning rollers 11 with a rotary motion about their respective axes, so as apply traction to the fabric 12 being formed; according to the invention, said actuation means comprise, for each one of the tensioning rollers 11, a motor 14 which can be actuated independently or in correlation with the actuation of the motors that actuate the other tensioning rollers 11 so as to perform, according to production requirements, uniform or differentiated tensioning in the various regions of the fabric contacted by the tensioning rollers 11.

In the illustrated embodiment, the tensioning rollers 11 are arranged so that their axes 11*a* lie along a polygonal line inside the needle cylinder 2. Likewise, the contrast rollers 13 also are supported, so that they can rotate about their respective axes, which are parallel to the various axes 11*a* of the tensioning rollers 11, by a respective supporting structure 30 which is arranged inside the needle cylinder 2.

The supporting structure 30 comprises, for each contrast roller 13, a lever 31 which is pivoted, by means of an intermediate portion, to a frame 32 which is rigidly coupled to the needle cylinder 2 in its rotary motion about the axis 2*a*. The lever 31 supports, proximate to one of its ends, the corresponding contact roller 13 so that it can rotate freely about its own axis, which is parallel to the axis about which the lever 31 is pivoted to the frame 32. A spring 33 acts on the end of the lever 31 that lies opposite the end that supports the contact roller 13; said spring pushes the contact roller 13 against the corresponding tensioning roller 11.

Figure 3:
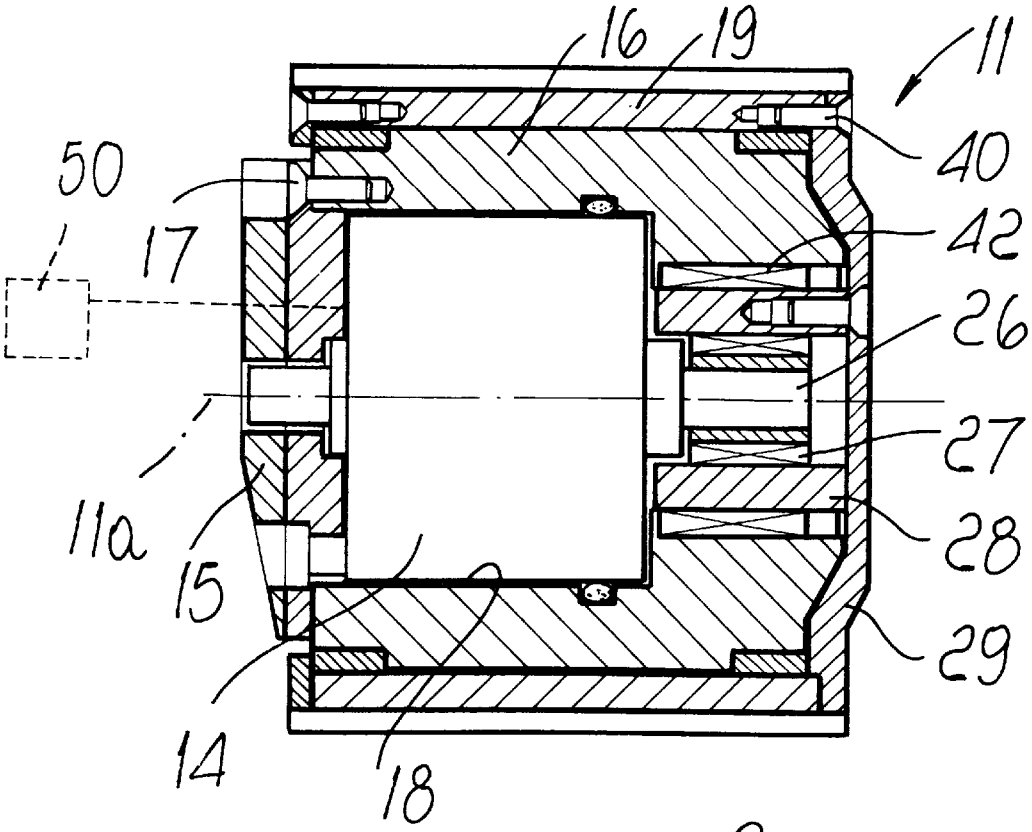
FIG. 3 is an axial sectional view of a tensioning roller of the device according to the invention.
Figure 4:
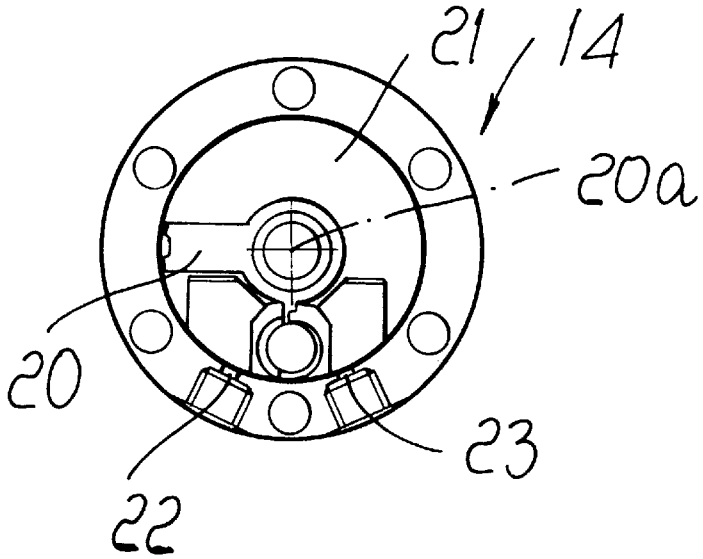
FIG. 4 is a schematic transverse sectional view of the motor with which each tensioning roller is equipped.

Each tensioning roller 11 is supported by a supporting structure 15 so that it can rotate about the corresponding axis 11*a*. The motor 14, which actuates each tensioning roller 11, is preferably accommodated inside the corresponding tensioning roller 11. As shown in particular in FIG. 3, inside each tensioning roller 11 there is a hollow supporting cylinder 16 which is fixed to the supporting structure 15, for example by means of screws 17.

The hollow cylinder 16 is arranged coaxially inside the corresponding tensioning roller 11 and is internally provided with a cavity 18 which accommodates the motor 14, which is rigidly coupled, through its body, to the supporting structure 15. The curved surface 19 of the tensioning roller 11 lies outside the hollow supporting cylinder 16 and is optionally covered, on its outer side, with a layer of high-adhesion material to prevent accidental slippage of the tensioning roller 11 with respect to the fabric 12.

The motor 14 is preferably constituted by a pneumatically-actuated rotary motor with a rotor 20 which can be rotated through 360° or less about its own axis 20*a*, which preferably coincides with the axis 11*a* of the corresponding tensioning roller 11. In practice, inside the body of the motor 14 there is a cylindrical chamber 21 inside which the rotor 20 is supported so that it can rotate about its own axis 20*a*. The rotor 20 has a shape which divides the cylindrical chamber 21 into two portions, each of which is connected to a port 22 and 23. The ports 22 and 23 are selectively connected to a compressed air feed duct or to an exhaust so as to produce the alternating rotation of the rotor 20 inside the cylindrical chamber 21.

The output shaft 26 of the motor 14, rigidly coupled to the rotor 20, is connected to the curved surface 19 of the tensioning roller 11 by means of a first unidirectional rotary coupling 27, preferably constituted by a unidirectional bearing, which allows to transmit the rotary motion from the rotor 20 to the curved surface 19 of the tensioning roller 11 only in the direction of the rotation of the tensioning roller 11 that tensions the fabric 12.

The unidirectional bearing 27 is interposed between the output shaft 26 of the motor 14 and a sleeve 28 which is arranged coaxially to the tensioning roller 11 and is fixed to a cover 29 which is fixed, for example by means of screws 40, to the curved surface 19 of the tensioning roller 11.

Conveniently, a second unidirectional rotary coupling 42 is interposed between the sleeve 28 and the hollow supporting cylinder 16, i.e., between the tensioning roller 11 and the supporting structure 15; said second coupling is preferably constituted by a unidirectional bearing which is meant to prevent the tensioning roller 11 from rotating in the opposite direction with respect to the rotation of the tensioning roller that tensions the fabric 12.

In practice, the second unidirectional coupling 42 is meant to prevent accidental rotation of the tensioning roller 11 in the opposite direction with respect to the direction that tensions the fabric 12 when the rotor 20 of the motor 14 is performing its return rotation, in the opposite direction with respect to the direction of rotation that tensions the fabric 12. Said second unidirectional rotary coupling 42 might also be omitted if a tensioning roller 11 is actuated, in the direction that tensions the fabric 12, alternately with the actuation of the contiguous rollers. In practice, in this case a retraction of the fabric 12 produced by the elasticity of said fabric, in the opposite direction with respect to the correct tensioning direction, during the return rotation of the rotor 20, is in any case prevented, since the fabric continues to be retained by the contiguous tensioning rollers 11, which are in another actuation step, i.e., in a step which is different from the return step of the rotor 20.

Conventional means, indicated by the reference numeral 50, for adjusting the supply pressure of the motors 14 so as to correspondingly vary the degree of tension of the fabric 12 according to the requirements, can be provided on the compressed air line that feeds the various motors 14.

The motors 14 can also be of the individually-actuated type, i.e., with intervention times and supply pressures which can be adjusted individually for each motor, or can be divided into actuation groups; for example, it is possible to provide for two actuation groups by alternately connecting the actuation motor of one tensioning roller 11 to a first compressed air supply circuit and the motor for actuating the contiguous tensioning roller to a second compressed air supply circuit, so that each one of the two groups can be actuated with different intervention times and pressures with respect to the other group.

Of course, according to the requirements it is possible to provide for a plurality of actuation groups instead of just two actuation groups.

It should be noted that the device according to the invention has been described with particular reference to its application in a large-diameter circular knitting machine; however, it may also be installed in straight-bar machines. In this case, the axes of the various tensioning rollers 11 are aligned instead of being arranged along a polygonal line as shown.

The operation of the device according to the invention is as follows.

The fabric 12, during its forming, descends between the rollers 11 and the contrast rollers 13. The motors 14 of the various tensioning rollers 11 are actuated differently so as to ensure, in any case, a substantially uniform tension of the fabric as a whole, according to the knitting being performed, and therefore taking into account the fact that some needle groups can be knitting while other needle groups can be inactive, thus forming fabric in some regions while no fabric is formed in other regions, or the fact that some regions of the fabric are produced so as to be longer than other regions of the fabric. By virtue of this fact, even if there is an extreme diversification of the knitting in the various regions of the fabric, a uniform result in terms of fabric tensioning and therefore perfect stitch holding on the various needles of the machine is nonetheless achieved.

If instead the fabric 12 is knitted practically with the same knitting style on all the needles of the machine, i.e., so that the various regions of the fabric advance in a uniform manner, the rollers 11 can be actuated uniformly, leading in any case to the result of uniform tension in the various regions of the fabric.

In practice, it has been found that the device according to the invention, by virtue of the fact that the tensioning rollers can be actuated independently or in correlation with each other, according to the requirements, fully achieves the intended aim, since uniform tension over the entire extension of the fabric is ensured regardless of the type of knitting being manufactured and of any differentiation in the knitting styles in various regions of the fabric.

The device thus conceived is susceptible of numerous modifications and variations, all of which are within the scope of the inventive concept; all the details may furthermore be replaced with other technically equivalent elements.

In practice, the materials used, as well as the dimensions, may be any according to the requirements and the state of the art.

What is claimed is:

1. A device for tensioning a knitted fabric in a knitting machine, comprising: a plurality of tensioning rollers arranged side by side so as to act on a first face of the fabric at an area covering substantially all of a transverse extension thereof, said tensioning rollers adapted to be provider below a needle work area of the machine; a plurality of contact rollers, each cooperating with a respective one of said tensioning rollers, said contact rollers acting on a second face of the fabric being opposite to the first face that makes contact with said tensioning rollers, said tensioning and contact rollers defining each axes thereof which are orientated so that the axis of a contact roller is parallel to the axis of a corresponding tensioning roller; actuation means for actuating said tensioning rollers to rotate each about a respective axis thereof for applying traction to the fabric being formed; wherein said actuation means comprise a plurality of motors, said motors being provided one for each one of said tensioning rollers, with each motor being actuatable independently, and further, selectively in correlation with other motors of said plurality of motors that actuate other tensioning rollers of said plurality of tensioning rollers.

2. The device of claim 1, wherein each of said motors is accommodated inside a corresponding tensioning roller.

3. The device of claim 2, comprising a plurality of first unidirectional rotary couplings, and wherein each motor of said plurality of motors has a rotor, said rotor being actuatable with a reciprocating motion about an axis of the rotor, said tensioning rollers comprising an external curved surface thereof and said rotor being connected to the curved surface of a corresponding tensioning roller by way of a said first unidirectional rotary coupling so as to transmit rotary motion of said rotor to the curved surface of the corresponding tensioning roller-only in a direction of rotation providing tensioning of the fabric.

4. The device of claim 3, comprising: a plurality of supporting structures each of which supporting one of said tensioning rollers so as to be rotatable about said rotor axis; a plurality of second unidirectional rotary couplings each of which being interposed between a respective said tensioning roller and a respective said supporting structure, said second unidirectional rotary couplings allowing rotation of each said corresponding tensioning rollers about the roller axis thereof with respect to the corresponding supporting structure thereof only in a direction of rotation that provides tensioning of the fabric.

5. The device of claim 3, wherein each of said motors is a pneumatically-actuated rotary motor having a rotor which is reciprocatingly actuatable over a rotation angle of 0°–360°.

6. The device of claim 4, wherein said first unidirectional couplings are constituted by unidirectional bearings which are interposed each between a said rotor of a said motor and a respective said curved surface of a said corresponding tensioning roller.

7. The device of claim 4, wherein said second unidirectional couplings are constituted by unidirectional bearings which are interposed each between a said supporting structure and a said corresponding tensioning roller.

8. The device of claim 5, comprising adjustment means for adjusting a supply pressure of said pneumaticallyactuated rotary motors.

9. The device of claim 1, wherein the motors for actuating said tensioning rollers are divided into at least two groups, with the motors of one group being actuatable independently from the motors belonging to a further group.

10. A combination of a device for tensioning knitted fabrics and circular knitting machine, the device for tensioning comprising: a plurality of tensioning rollers arranged side by side so as to act on a first face of the fabric at an area covering substantially all of a transverse extension thereof, said tensioning rollers adapted to be provided below a needle work area of the machine; a plurality of contact rollers, each cooperating with a respective one of said tensioning rollers, said contact rollers acting on a second face of the fabric being opposite to the first face that makes contact with said tensioning rollers, said tensioning and contact rollers defining each axes thereof which are orientated so that the axis of a contact roller is parallel to the axis of a corresponding tensioning roller; actuation means for actuating said tensioning rollers to rotate each about a respective axis thereof for applying traction to the fabric being formed; wherein said actuation means comprise a plurality of motors, said motors being provided one for each one of said tensioning rollers, with each motor being actuatable independently, and further, selectively in correlation with other motors of said plurality of motors that actuate other tensioning rollers of said plurality of tensioning rollers, said tensioning rollers being arranged with the axes thereof lying along a polygonal line inside a needle cylinder of the machine.

* * * * *